US008690529B2

(12) United States Patent
Tanaka et al.

(10) Patent No.: US 8,690,529 B2
(45) Date of Patent: Apr. 8, 2014

(54) BLOWER

(75) Inventors: Yuuri Tanaka, Aichi (JP); Seiji Shirahama, Aichi (JP); Kazuhiro Taniguchi, Aichi (JP)

(73) Assignee: Panasonic Corporation, Osaka (JP)

( * ) Notice: Subject to any disclaimer, the term of this patent is extended or adjusted under 35 U.S.C. 154(b) by 597 days.

(21) Appl. No.: 12/994,957

(22) PCT Filed: Jan. 13, 2010

(86) PCT No.: PCT/JP2010/000124

§ 371 (c)(1),
(2), (4) Date: Nov. 29, 2010

(87) PCT Pub. No.: WO2011/086592

PCT Pub. Date: Jul. 21, 2011

(65) Prior Publication Data

US 2011/0250060 A1 Oct. 13, 2011

(51) Int. Cl.
*F04D 29/54* (2006.01)

(52) U.S. Cl.
USPC ..... 415/204

(58) Field of Classification Search
USPC ..... 415/204; 454/354, 367, 346
See application file for complete search history.

(56) References Cited

U.S. PATENT DOCUMENTS 5,620,370 A * 4/1997 Umai et al. ..... 454/354

FOREIGN PATENT DOCUMENTS

| | | |
|---|---|---|
| JP | S47-29705 | 9/1972 |
| JP | 06-207733 | 7/1994 |
| JP | 09-152163 | 6/1997 |
| JP | 09-209994 | 8/1997 |
| JP | 2009-191721 | 8/2009 |

OTHER PUBLICATIONS

Japanese version of International Search Report of PCT/JP2010/000124, mailed on Feb. 16, 2010.

* cited by examiner

*Primary Examiner* — Nathaniel Wiehe
*Assistant Examiner* — Brian O Peters
(74) *Attorney, Agent, or Firm* — Panasonic Patent Center

(57) ABSTRACT

A blower drawing air into the air path and discharging air to the discharge duct, including: a frame forming an outer shell; a fan driven by a motor and having a fan outlet, inside the frame; a duct connection part having a duct connection opening, connected to the discharge duct, outside the frame; and an in-frame blow-out part connecting the duct connection part with the fan outlet, inside the frame. The cross-section shape of the air path changes continuously and smoothly at the in-frame blow-out part and the duct connection part, from the fan outlet to the duct connection opening.

17 Claims, 8 Drawing Sheets

BLOWER

TECHNICAL FIELD

The present invention relates to a blower used in, for example, a ventilating air-conditioner.

BACKGROUND ART

Conventionally, there is known a blower used in a ceiling built-in ventilating fan as this type (refer to patent literature 1, for example).

Hereinafter, a description is made of such a blower referring to FIG. 9, which is a sectional side view showing a conventional blower.

As shown in FIG. 9, blower 101 includes frame 102, casing 105, fan 106, motor 107, top plate 108, and adaptor 112. Here, casing 105 is spiral and has casing inlet 103 drawing outside air into frame 102 and casing outlet 104 blowing out air. Fan 106 sends air from casing inlet 103 to casing outlet 104. Motor 107 rotarily drives fan 106. Top plate 108 fixes casing 105 with motor 107. Adaptor 112 has adaptor inflow opening 109 communicating with casing outlet 104 and duct connection opening 111 for blowing out air toward duct 110.

Casing outlet 104 has a rectangle cross section. The cross-section shape changes from a rectangle to a round shape from adaptor inflow opening 109 to duct connection opening 111.

In such a conventional blower, air passes through inside adaptor 112 over a short distance. Further, the cross-section shape sharply changes from the rectangle of adaptor inflow opening 109 to the round shape of duct connection opening 111. This decreases the blowing efficiency due to pressure loss in an air flow from fan 106 and generates noise due to turbulent flows.

PRIOR ART DOCUMENTS

Patent Literature

[Patent literature 1] Japanese Patent Unexamined Publication No. H09-209994

SUMMARY OF THE INVENTION

The present invention is a blower that draws air into the air path and discharges air to the discharge duct. The blower includes: a frame forming an outer shell; a fan driven by a motor and having a fan outlet, the fan being inside the frame; a duct connection part having a duct connection opening, connected to the discharge duct, outside the frame; and an in-frame blow-out part connecting the duct connection part with the fan outlet, the in-frame blow-out part being inside the frame. The cross-sectional shape of the air path changes continuously and smoothly at the in-frame blow-out part and the duct connection part from the fan outlet to the duct connection opening.

In a blower with such a configuration, the cross-sectional shape changes gently from the fan outlet to the duct connection opening, thereby reducing pressure loss and decreasing turbulent flows. This prevents the blowing efficiency from decreasing and reduces noise.

DETAILED DESCRIPTION OF PREFERRED EMBODIMENT

Hereinafter, a description is made of an embodiment of the present invention with reference to the related drawings.

Exemplary Embodiment

Figure 1:
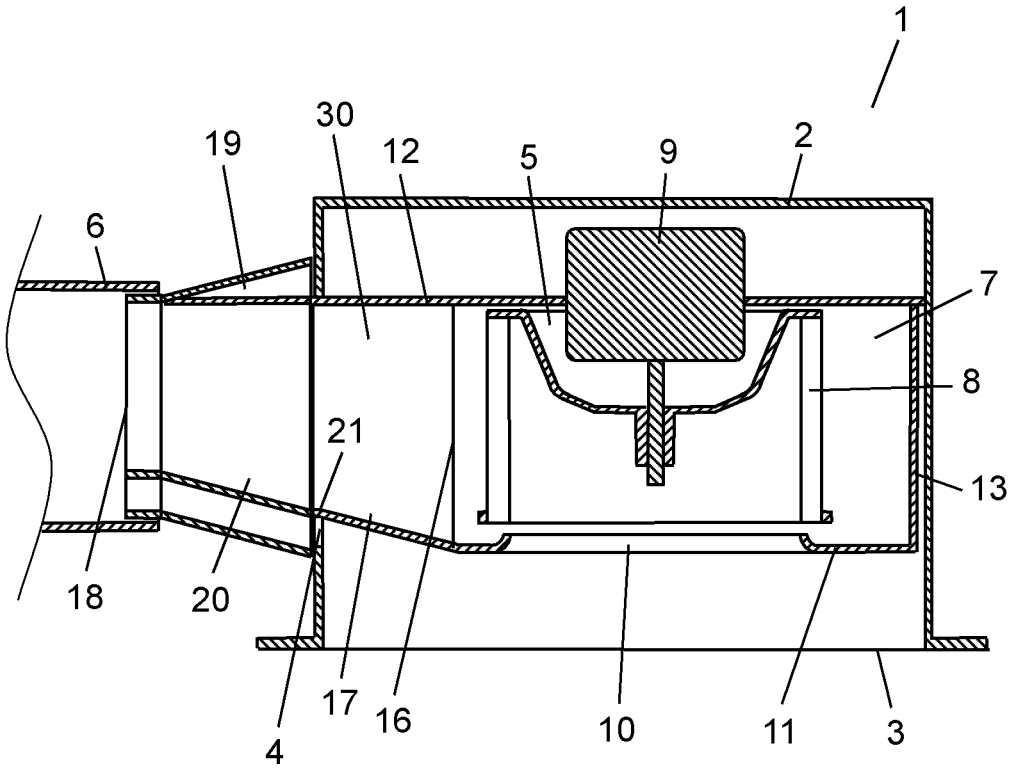
FIG. 1 is a sectional side view of a blower according to an embodiment of the present invention.
Figure 2:
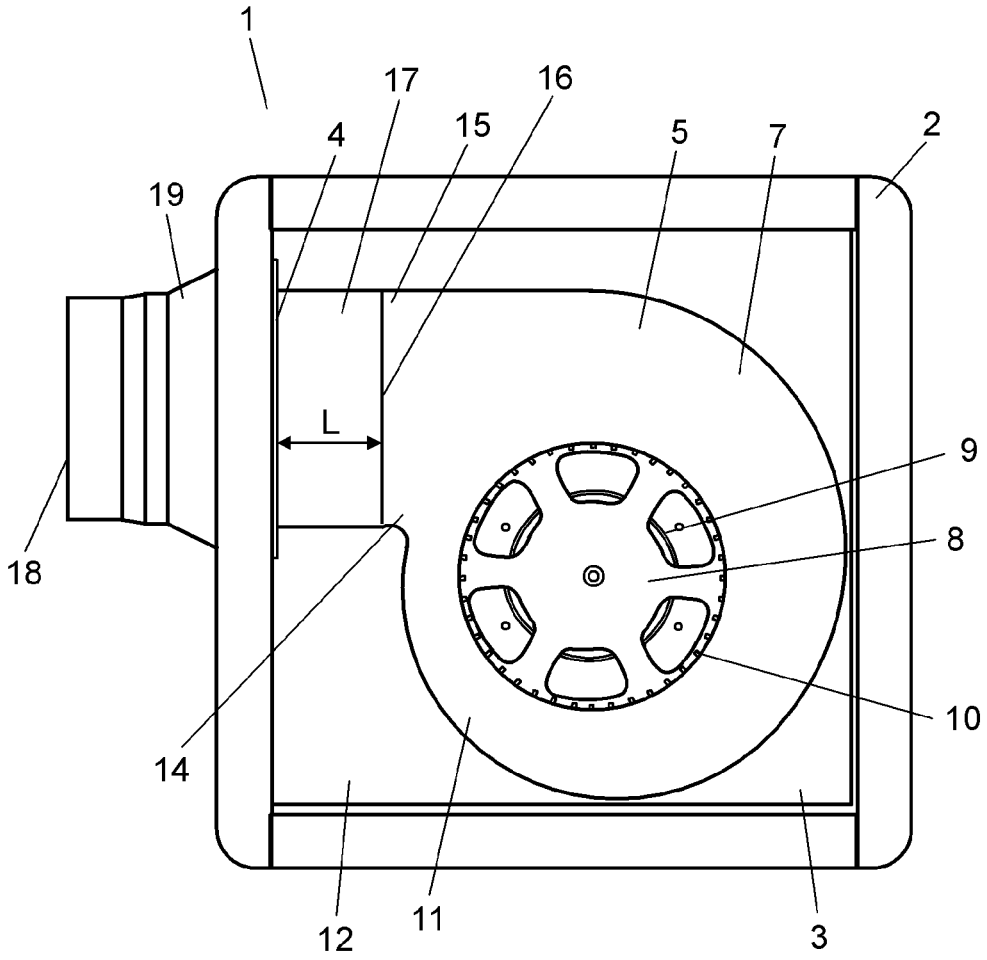
FIG. 2 is a plan view of the blower viewed from the casing inlet.

FIG. 1 is a sectional side view of a blower according to an embodiment of the present invention. FIG. 2 is a plan view of the blower, viewed from the casing inlet. Blower 1 includes frame 2 with an outer shell of a rectangular solid (270 mm in length by 270 mm in width by 200 mm in height, for example). Frame 2 has frame inlet 3 in its bottom surface and frame outlet 4 in its side surface.

Frame 2 has fan 5 arranged on its inside. Fan 5 is driven by motor 9 and has fan outlet 16. Fan 5 is a centrifugal fan such that it can reliably discharge air even for a high static pressure load on fan 5 due to such as long discharge duct 6. Fan 5 includes casing 7 with its planar shape being spiral, impeller 8 disposed in casing 7, and motor 9 for driving impeller 8 (e.g. a multiblade impeller of 145 mm in external diameter and 100 mm in height, for example). The centrifugal fan allows the static pressure condition of fan 5 to be improved owing to a scroll casing. This prevents the blowing efficiency from decreasing even for a high static pressure load on fan 5 due to such as a long duct.

Casing 7 includes inlet plate 11, top plate 12, and outer circumferential wall 13. Here, inlet plate 11 has fan inlet 10, which faces frame inlet 3 and communicates with frame inlet 3. Top plate 12 faces inlet plate 11 and has motor 9 fixed thereto. Outer circumferential wall 13 encloses impeller 8. Top plate 12 is plate-like metal; is larger in outer shape than outer circumferential wall 13; extends to near frame outlet 4; and is fixed to frame 2.

Outer circumferential wall 13 of casing 7 is spiral and its distance to impeller 8 gradually increases in the rotation direction of impeller 8 from tongue 14 (i.e. the starting point of the spiral). Tongue-facing position 15 facing tongue 14 is the endpoint of the spiral, which is fan outlet 16.

Here, air path 30 is an airflow path from fan outlet 16 to discharge duct 6. That is, blower 1 according to the embodiment of the present invention draws air into air path 30 and discharges air to duct 6.

Duct connection part 19 has duct connection opening 18, which is positioned outside frame 2 and is connected to discharge duct 6.

Figure 3:
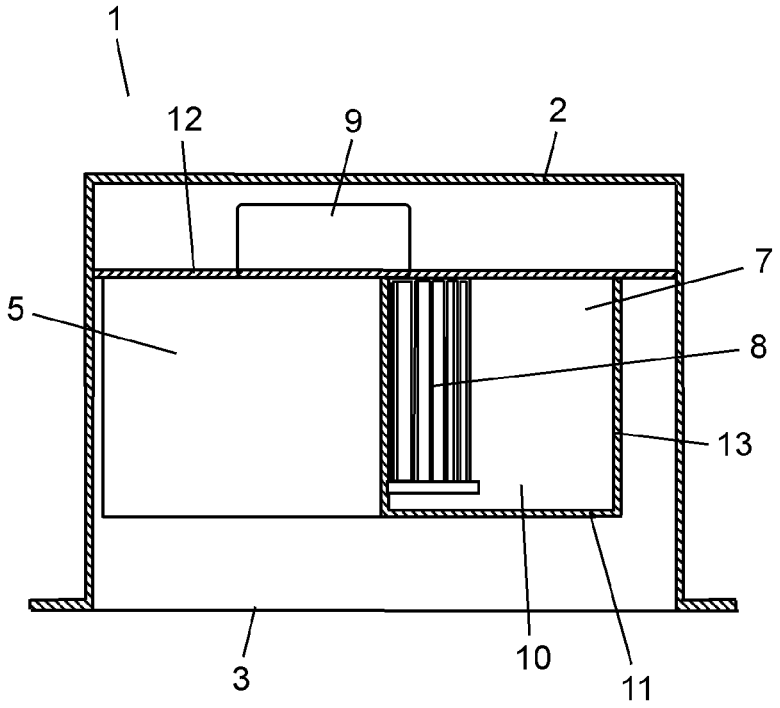
FIG. 3 is a sectional view of the blower, at the fan outlet.

FIG. 3 is a sectional view of the blower according to the embodiment of the present invention, at the fan outlet. As shown in FIG. 3, fan outlet 16 is rectangular similarly to a typical centrifugal fan. Fan outlet 16 is 95 mm in width, 105 mm in height, and 112 mm in equivalent diameter (the diameter of a circle of the same area).

In this embodiment, fan outlet 16 is rectangular to maximize the air volume; however, fan outlet 16 is preferably round or elliptical to connect to a round duct, which means fan outlet 16 may be of a shape other than a rectangle according to the type and form of fan 5.

Fan outlet 16 is positioned at a predetermined distance L (e.g. 58 mm) from frame outlet 4. Fan outlet 16 is connected to in-frame blow-out part 17, one surface of which is plate-like top plate 12, one end of which extends to frame outlet 4. The length of in-frame blow-out part 17 is the same as the distance between fan outlet 16 and frame outlet 4. In other words, in-frame blow-out part 17 is positioned inside frame 2 to connect duct connection part 19 to fan outlet 16.

Frame 2 has duct connection part 19 detachably connected to the outer circumference of frame outlet 4 so as to be easily connected to a round duct. Here, the round duct is approximately 100 mm to 110 mm in internal diameter, which is typically used for piping such as a ventilating device. Duct connection part 19 (e.g. a length of 90 mm) has round duct connection opening 18 with an external diameter of 97 mm at its end. Duct connection opening 18 with a round cross section allows air to be discharged smoothly to a typically used duct with a round cross section. Consequently, blower 1 reduces pressure loss and decreases turbulent flows, which prevents the blowing efficiency from decreasing and reduces noise.

Frame 2 is provided with duct connection part 19 detachably. As a result, to connect blower 1 to a duct disposed in a roof space or wall, frame 2 can be connected to duct connection part 19 after duct connection part 19 is connected to the duct.

Figure 4:
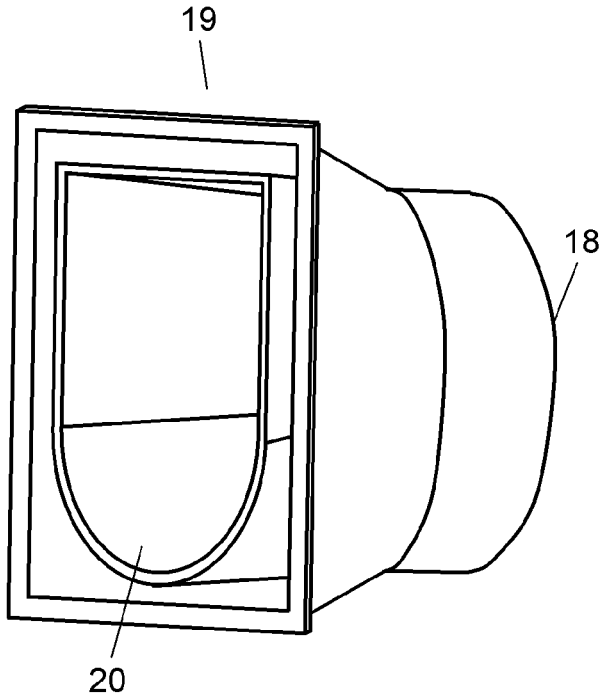
FIG. 4 is a perspective view of the duct connection part of the blower.

FIG. 4 is a perspective view of the duct connection part of a blower according to the embodiment of the present invention. As shown in FIG. 4, duct connection part 19 is made of metal so as to have rigidity resistant to such as deformation due to the load of discharge duct 6. The side of duct connection part 19 close to frame outlet 4 is expanded more widely than frame outlet 4, resulting in the opening being larger in area than frame outlet 4. Duct connection part 19 is provided therein with resin-made inner circumferential duct 20 one end of which is joined to duct connection opening 18 with a round cross section of duct connection part 19. Duct connection part 19 thus has a double structure having an outer circumferential component including duct connection opening 18 and an inner circumferential component connected to in-frame blow-out part 17. Herewith, the outer circumferential component including duct connection opening 18 on which a load of a duct is exerted can be made of a rigid body such as metal to increase the strength of components. Meanwhile, since the outer circumferential component is connected to in-frame blow-out part 17, the inner circumferential component can be easily produced by such as resin-molding.

Figure 5:
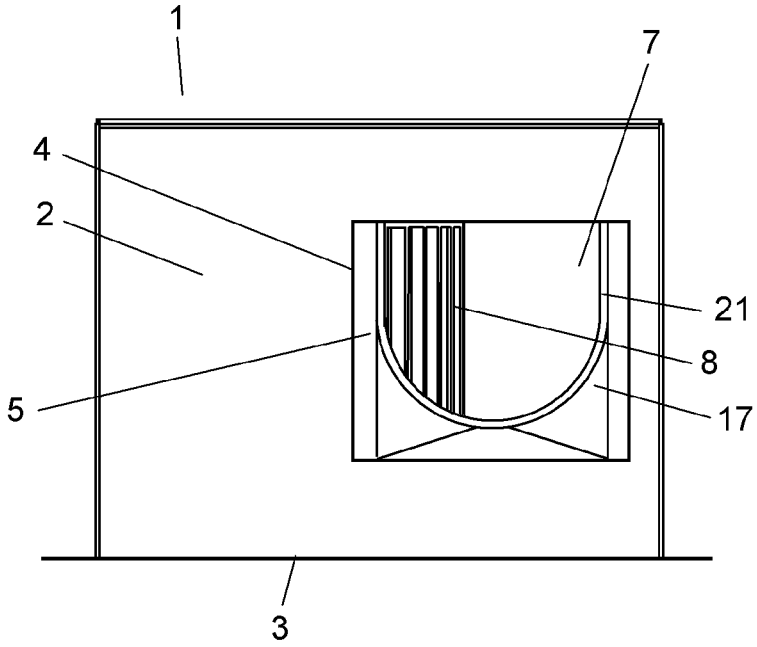
FIG. 5 is a front view of the frame outlet of the blower, with the duct connection part removed.

FIG. 5 is a front view of the frame outlet of the blower according to the embodiment of the present invention, with the duct connection part removed. As shown in FIGS. 4 and 5, the opening of inner circumferential duct 20 close to frame outlet 4 is the same in shape as that of in-frame blow-out part 17 extending to frame outlet 4. That is, the cross-section shape of in-frame blow-out part 17 is rectangular with its bottom side arc-shaped so as to be connected to duct connection opening 18 smoothly. The outer shape of duct connection part 19 has a curved surface shape such that it connects duct connection opening 18 to in-frame blow-out part 17 smoothly. Herewith, the cross-section shape gently changes from fan outlet 16 to duct connection opening 18 not only for an axial-flow fan (round fan outlet 16) but also for such as a centrifugal fan (rectangular fan outlet 16). Consequently, blower 1 reduces pressure loss and decreases turbulent flows.

The cross section of in-frame blow-out part 17 is also rectangular with its bottom side arc-shaped (not illustrated). The radius of the arc decreases at shorter distances from fan outlet 16 to frame outlet 4, and the cross-section shape changes continuously and smoothly from rectangular fan outlet 16 to frame outlet 4. In other words, the cross-section shape of air path 30 changes continuously and smoothly at in-frame blow-out part 17 and duct connection part 19 from fan outlet 16 to duct connection opening 18.

A joint part between inner circumferential duct 20 of duct connection part 19 and in-frame blow-out part 17 is provided with projection 21 with the same thickness as that of frame 2. Inner circumferential duct 20 and projection 21 are structured to contact each other to prevent air leakage, noise, and a decrease in blowing efficiency. The joint part between in-frame blow-out part 17 and duct connection part 19 thus includes an air leakage preventive part. An air leakage preventive part of projection 21 can be easily produced.

As described above, connection is made from fan outlet 16 inside frame 2 to duct connection opening 18 outside frame 2 through in-frame blow-out part 17 and the inner circumferential duct 20 with the cross-sectional area changed continuously and smoothly. Thus, the area of duct connection opening 18 is smaller than that of fan outlet 16. The cross-sectional area of in-frame blow-out part 17 and the inner circumferential duct 20 gradually decreases at smaller distances to duct connection opening 18. In other words, the cross-sectional areas of in-frame blow-out part 17 and duct connection part 19 gradually decrease from fan outlet 16 to duct connection opening 18. This allows using large fan 5 relative to the diameter of the duct and improves the static pressure condition of fan 5, which prevents the blowing efficiency from decreasing even for a high static pressure load on fan 5 due to such as a long duct.

With such a configuration, the shape and cross-sectional area are changed continuously and smoothly using a long distance of in-frame blow-out part 17 inside frame 2 in addition to duct connection part 19 outside frame 2. As a result, pressure loss and turbulent flows are reduced, thereby preventing a decrease in blowing efficiency and noise.

In this embodiment, inlet plate 11 of casing 7, outer circumferential wall 13, and in-frame blow-out part 17 (excluding top plate 12) are integrally formed. Then, plate-like top plate 12 forms casing 7 and part of in-frame blow-out part 17. This simplifies the structures of casing 7 in frame 2 and in-frame blow-out part 17 and facilitates their installation greatly.

In this embodiment, duct connection part 19 is detachable. Consequently, to connect blower 1 to discharge duct 6 disposed in a roof space or wall, frame 2 can be connected to duct connection part 19 after duct connection part 19 is connected to discharge duct 6, thereby facilitating their installation With such a configuration, rotating motor 9 to operate fan 5 causes impeller 8 to operate so as to pressurize air led to inside casing 7 through fan inlet 10, in casing 7. Then, the air led into casing 7 passes through fan outlet 16, in-frame blow-out part 17, and duct connection part 19, and is discharged to discharge duct 6 connected to duct connection opening 18.

The cross-sectional area changes continuously and smoothly while decreasing gradually from fan outlet 16 inside frame 2 to duct connection opening 18 outside frame 2 through in-frame blow-out part 17 and duct connection part 19. That is, in-frame blow-out part 17 gradually curves at parts other than top plate 12 from rectangular fan outlet 16 toward duct connection part 19; decreases the cross-sectional area to change the shape into a half-round opening; and smoothly joins to inner circumferential duct 20 at frame outlet 4. Inner circumferential duct 20 gradually curves at the linear shape close to top plate 12; and decreases the cross-sectional area to smoothly join to round duct connection opening 18. Consequently, the cross-section shape changes gently, which reduces pressure loss and turbulent flows, thereby preventing a decrease in blowing efficiency and noise.

The length of in-frame blow-out part 17 is 0.52 times the equivalent diameter of the area of fan outlet 16, which is within a range between 0.3 and 1.0 times. As a result, uneven velocity distribution due to a spin and variation of airflow at fan outlet 16 is gradually uniformized at in-frame blow-out part 17. This reduces pressure loss and turbulent flows, thereby preventing a decrease in blowing efficiency and noise.

Here, if the length of in-frame blow-out part 17 is shorter than 0.3 times the equivalent diameter of the area of fan outlet 16, uneven air velocity distribution at fan outlet 16 cannot be adequately uniformized; if 1.0 times, adequately uniformized; if longer than 1.0 times, blower 1 enlarges unnecessarily. Accordingly, the length is desirably between 0.3 and 1.0 times the equivalent diameter of the area of the fan outlet.

The length of duct connection part 19 is 0.93 times the equivalent diameter of the area of round duct connection opening 18, which is within a range between 0.5 and 1.5 times. As a result, velocity distribution uniformized incompletely is gradually uniformized at duct connection part 19. This reduces pressure loss and turbulent flows, thereby preventing a decrease in blowing efficiency and noise.

Here, if the length of duct connection part 19 is shorter than 0.5 times the diameter of round duct connection opening 18, velocity distribution incompletely uniformized at in-frame blow-out part 17 cannot be uniformized adequately; if 1.5 times, adequately uniformized; if longer than 1.5 times, duct connection part 19 enlarges unnecessarily. Accordingly, the length is desirably between 0.5 and 1.5 times the equivalent diameter of the area of the duct connection opening.

In this embodiment, the length of in-frame blow-out part 17 is between 0.3 and 1.0 times the equivalent diameter of the area of fan outlet 16. A length longer than 0.5 times more effectively reduces pressure loss and turbulent flows. A length shorter than 0.7 times allows downsizing blower 1.

In this embodiment, the length of duct connection part 19 is between 0.5 and 1.5 times the equivalent diameter of the area of round duct connection opening 18. If duct connection opening 18 is not round, it is adequate to use the diameter of a circle with the same area (i.e. equivalent diameter) as the reference. A length longer than 0.8 times more effectively reduces pressure loss and turbulent flows. A length shorter than 1.2 times allows downsizing blower 1.

Figure 6:
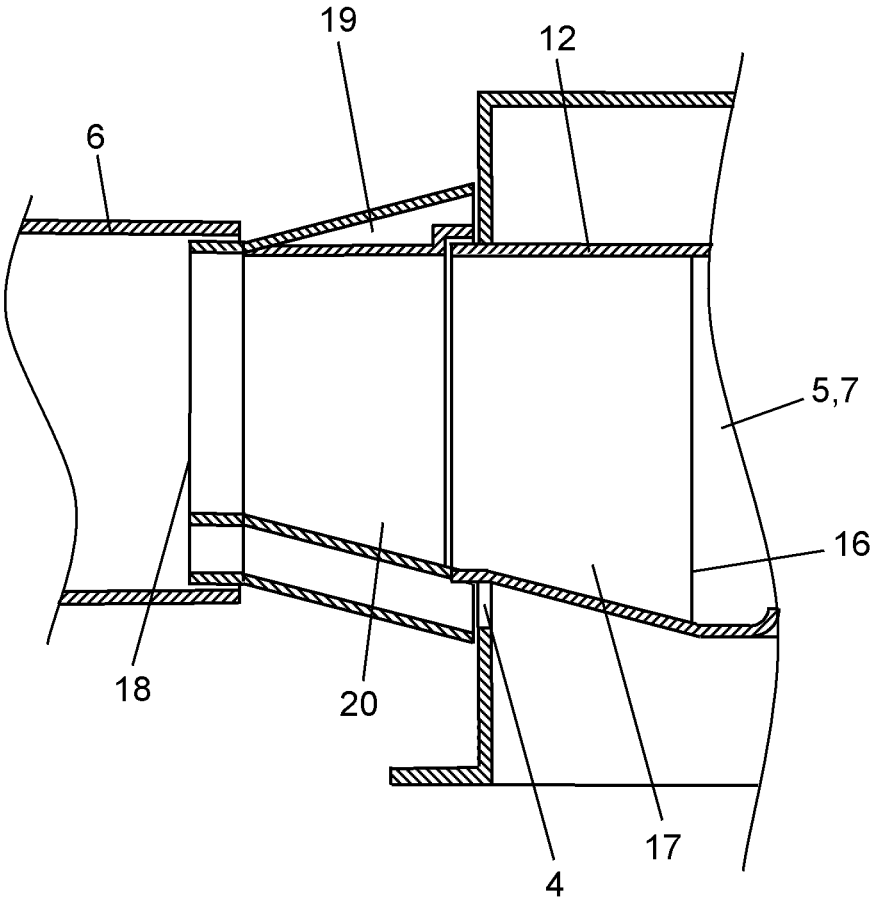
FIG. 6 is a partial sectional side view of the blower, with its in-frame blow-out part and duct connection part being in a fitting structure.

In this embodiment, projection 21 works as an air leakage preventive means at the joint part of inner circumferential duct 20 of duct connection part 19; however, in-frame blow-out part 17 and inner circumferential duct 20 of duct connection part 19 may be in a fitting structure as shown in FIG. 6, which is a partial sectional side view of the blower according to the embodiment of the present invention, with its in-frame blow-out part and duct connection part being in a fitting structure.

Part of the outer circumference of the cross section of in-frame blow-out part 17 may be a straight line. This allows a common plain-plate part to be used for composing part of fan 5 inside frame 2 and part of in-frame blow-out part 17. This simplifies the structure of blower 1 for easy production.

Figure 7:
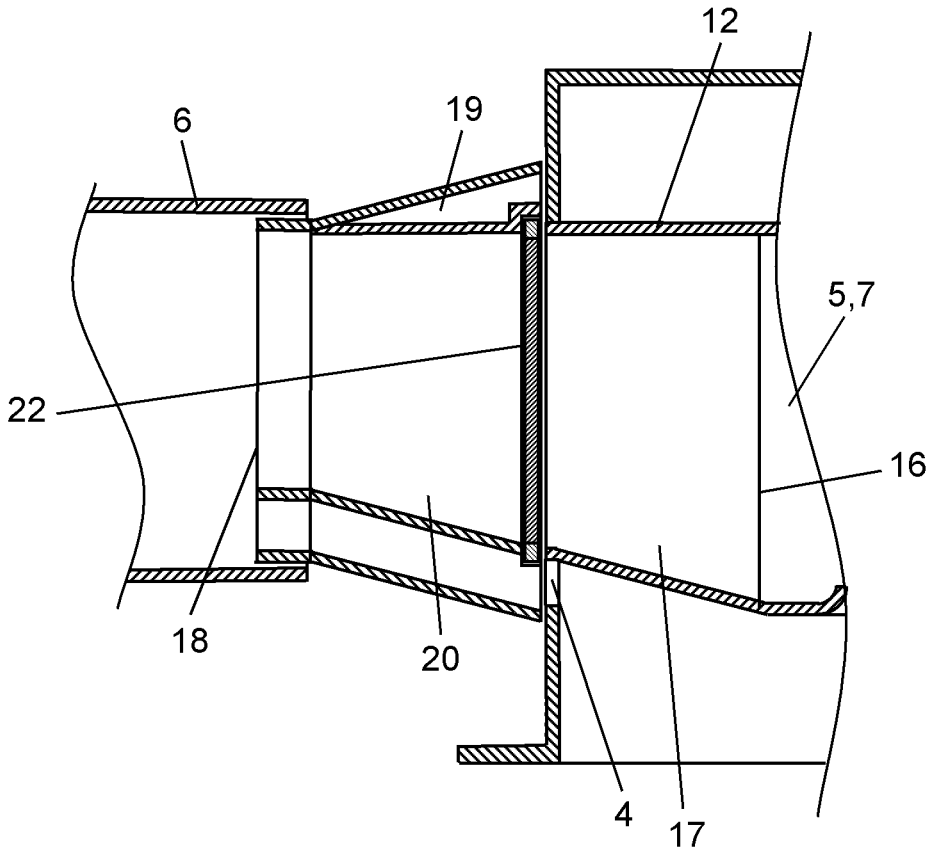
FIG. 7 is a partial sectional side view of the blower, with its in-frame blow-out part and duct connection part including packing.

FIG. 7 is a partial sectional side view of the blower according to the embodiment of the present invention, with its in-frame blow-out part and duct connection part including packing. As shown in FIG. 7, packing 22 may be provided at the joint part between in-frame blow-out part 17 and duct connection part 19. That is, the air leakage preventive part is packing 22 provided at the joint part.

Figure 8:
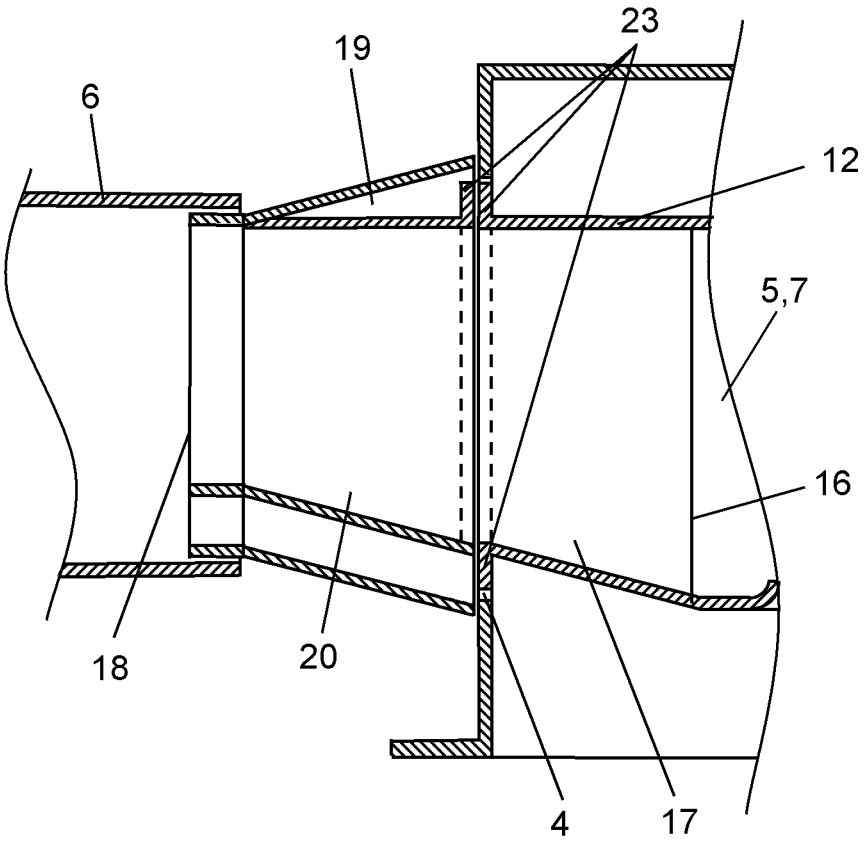
FIG. 8 is a partial sectional side view of the blower, with its in-frame blow-out part and duct connection part including flanges.
Figure 9:
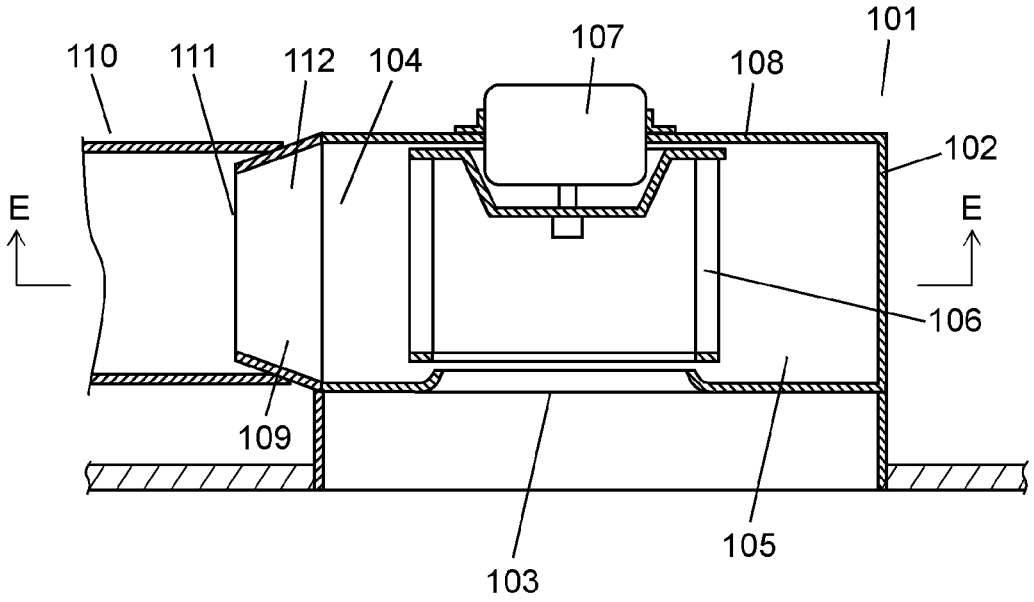
FIG. 9 PRIOR ART
FIG. 9 is a sectional side view of a conventional blower.

FIG. 8 is a partial sectional side view of the blower according to the embodiment of the present invention, with its in-frame blow-out part and duct connection part including flanges. As shown in FIG. 8, flanges 23 provided on the outer circumferences of duct connection part 19 and in-frame blow-out part 17 contact each other. Alternatively, frame 2 or packing 22 may be inserted between flanges 23. In other words, the air leakage preventive part has a structure such that flanges 23 provided on the outer circumferences of duct connection part 19 and in-frame blow-out part 17 contact each other. Such an air leakage preventive part (i.e. a fitting structure, packing 22, or flanges 23 contacting each other) can be easily produced.

INDUSTRIAL APPLICABILITY

A blower of the present invention enables preventing turbulent flows caused by pressure loss and reducing noise, and is thus useful for such as a ceiling built-in ventilating fan used for ventilating indoor air such as in a bathroom and washroom.

Reference Marks in the Drawings

1 Blower
2 Frame
3 Frame inlet
4 Frame outlet
5 Fan
6 Discharge duct
7 Casing
8 Impeller
9 Motor
10 Fan inlet
11 Inlet plate
12 Top plate
13 Outer circumferential wall
14 Tongue
15 Tongue-facing position
16 Fan outlet
17 In-frame blow-out part
18 Duct connection opening
19 Duct connection part
20 Inner circumferential duct
21 Projection
22 Packing
23 Flange

The invention claimed is:

1. A blower drawing air into an air path and discharging air to a discharge duct, comprising:

a frame forming an outer shell;

a fan driven by a motor and having a fan outlet, the fan being inside the frame;

a duct connection part connected to the discharge duct and having a duct connection opening, the duct connection part being outside the frame; and an in-frame blow-out part connecting the duct connection part with the fan outlet, the in-frame blow-out part being inside the frame, wherein a cross-sectional shape of the in-frame blow-out part and the duct connection part changes continuously and smoothly from the fan outlet to the duct connection opening to provide the air path.

2. The blower of claim 1, wherein a cross-sectional shape of the duct connection opening is round.

3. The blower of claim 1, wherein the cross-sectional shape of the in-frame blow-out part is rectangular with a bottom side thereof being arc-shaped.

4. The blower of claim 1, wherein the fan is a centrifugal fan including a scroll casing.

5. The blower of claim 1, wherein a length of the in-frame blow-out part is between 0.3 and 1.0 times an equivalent diameter of an area of the fan outlet.

6. The blower of claim 1, wherein a length of the duct connection part is between 0.5 and 1.5 times an equivalent diameter of an area of the duct connection part.

7. The blower of claim 1, wherein the duct connection part has a double structure including an outer circumferential component having the duct connection opening and an inner circumferential component connecting to the in-frame blow-out part.

8. The blower of claim 1, wherein part of an outer circumference of a cross section of the in-frame blow-out part is a straight line.

9. The blower of claim 1, wherein the fan outlet is larger in area than the duct connection opening.

10. The blower of claim 9, wherein cross-sectional areas of the in-frame blow-out part and the duct connection part gradually decrease from the fan outlet to the duct connection opening.

11. The blower of claim 1, wherein the duct connection part is configured to be detachably connected to the frame.

12. The blower of claim 11, wherein a joint part between the in-frame blow-out part and the duct connection part includes an air leakage preventive part.

13. The blower of claim 12, wherein the joint part has a projection which has substantially the same thickness as a thickness of frame.

14. The blower of claim 12, wherein the air leakage preventive part has a fitting structure of the in-frame blow-out part and the duct connection part.

15. The blower of claim 12, wherein the air leakage preventive part is packing included in the joint part.

16. The blower of claim 12, wherein the air leakage preventive part has a structure in which flanges provided on respective outer circumferences of the duct connection part and the in-frame blow-out part contact each other.

17. A blower drawing air into an air path and discharging air to a discharge duct, comprising:

a frame forming an outer shell;

a fan driven by a motor and having a fan outlet, the fan being inside the frame;

a duct connection part connected to the discharge duct and having a duct connection opening, the duct connection part being outside the frame; and an in-frame blow-out part connecting the duct connection part with the fan outlet, the in-frame blow-out part being inside the frame, wherein the in-frame blow-out part includes a rectangular shaped top portion and an arc-shaped bottom potion, a radius of the arc-shaped bottom portion changes continuously and smoothly between the fan outlet and a frame outlet to thereby provide a continuous and smooth changing cross-sectional shape of the in-frame blow-out part and the duct connection part from the fan outlet to the duct connection opening and to provide the air path.

* * * * *